US007713041B2

(12) United States Patent
Bachmann et al.

(10) Patent No.: US 7,713,041 B2
(45) Date of Patent: May 11, 2010

(54) GEAR PUMP HAVING OPTIMAL AXIAL PLAY

(75) Inventors: Josef Bachmann, Obersinn (DE); Rolf Schwarze, Aalen (DE)

(73) Assignee: GKN Sinter Metals Holding GmbH, Radevormwald (DE)

( * ) Notice: Subject to any disclaimer, the term of this patent is extended or adjusted under 35 U.S.C. 154(b) by 130 days.

(21) Appl. No.: 11/332,523

(22) Filed: Jan. 13, 2006

(65) Prior Publication Data

US 2006/0140811 A1 Jun. 29, 2006

Related U.S. Application Data

(63) Continuation of application No. PCT/EP2004/007729, filed on Jul. 12, 2004.

(30) Foreign Application Priority Data

Jul. 14, 2003 (DE) ..... 103 31 979

(51) Int. Cl.
*F01C 21/00* (2006.01)
*F04C 15/00* (2006.01)

(52) U.S. Cl. ..... 418/179; 418/104; 418/166

(58) Field of Classification Search ..... 418/104, 418/131, 134, 166, 171, 179, 199
See application file for complete search history.

(56) References Cited

U.S. PATENT DOCUMENTS 2,312,655 A * 3/1943 Lauck ..... 418/179
2,816,702 A * 12/1957 Woodcock ..... 418/179
3,614,274 A * 10/1971 Ohrberg ..... 418/104
3,841,804 A * 10/1974 Drutchas et al. ..... 418/131
3,917,437 A * 11/1975 Link ..... 418/61.3
3,923,432 A 12/1975 Nakakobara ..... 418/61
4,128,366 A * 12/1978 Sone ..... 418/179
4,276,007 A * 6/1981 Sakamaki et al. ..... 418/178
4,492,545 A * 1/1985 Mochizuki et al. ..... 418/179
5,156,540 A * 10/1992 Fernau et al. ..... 418/171
5,452,997 A * 9/1995 Hekman et al. ..... 418/179
5,554,020 A * 9/1996 Rao et al. ..... 418/179
5,876,192 A 3/1999 Follmer ..... 418/149
6,619,937 B2 * 9/2003 Friedrichsen et al. ..... 418/61.3
6,918,749 B2 * 7/2005 Garczorz et al. ..... 418/179

(Continued)

FOREIGN PATENT DOCUMENTS

DE 27 20 223 6/1978

(Continued)

OTHER PUBLICATIONS

William Elmer Forsythe, Smithsonian Physical Tables, Published Electronic by Knovel 2003, paper publication in 1964, Ninth Revised Edition, pp. 149-151.*

*Primary Examiner*—Thomas E Denion
*Assistant Examiner*—Mary A Davis
(74) *Attorney, Agent, or Firm*—Woodcock Washburn LLP

(57) ABSTRACT

The invention relates to a pump, in particular an oil pump, for internal combustion engines, comprising a pump case, with the pump case comprising a pump lid and a pump flange, with at least one toothed wheelset being arranged between the pump lid and the pump flange and the pump lid and the pump flange being connected via at least one distance element.

13 Claims, 8 Drawing Sheets

U.S. PATENT DOCUMENTS 7,374,411 B2 * 5/2008 Nakakuki et al. ..... 418/179

FOREIGN PATENT DOCUMENTS

DE 3303247 A1 * 8/1983
DE 362 02 05 A1 12/1987
DE 199 29 952 C1 10/2000
DE 199 22 792 A1 11/2000

* cited by examiner

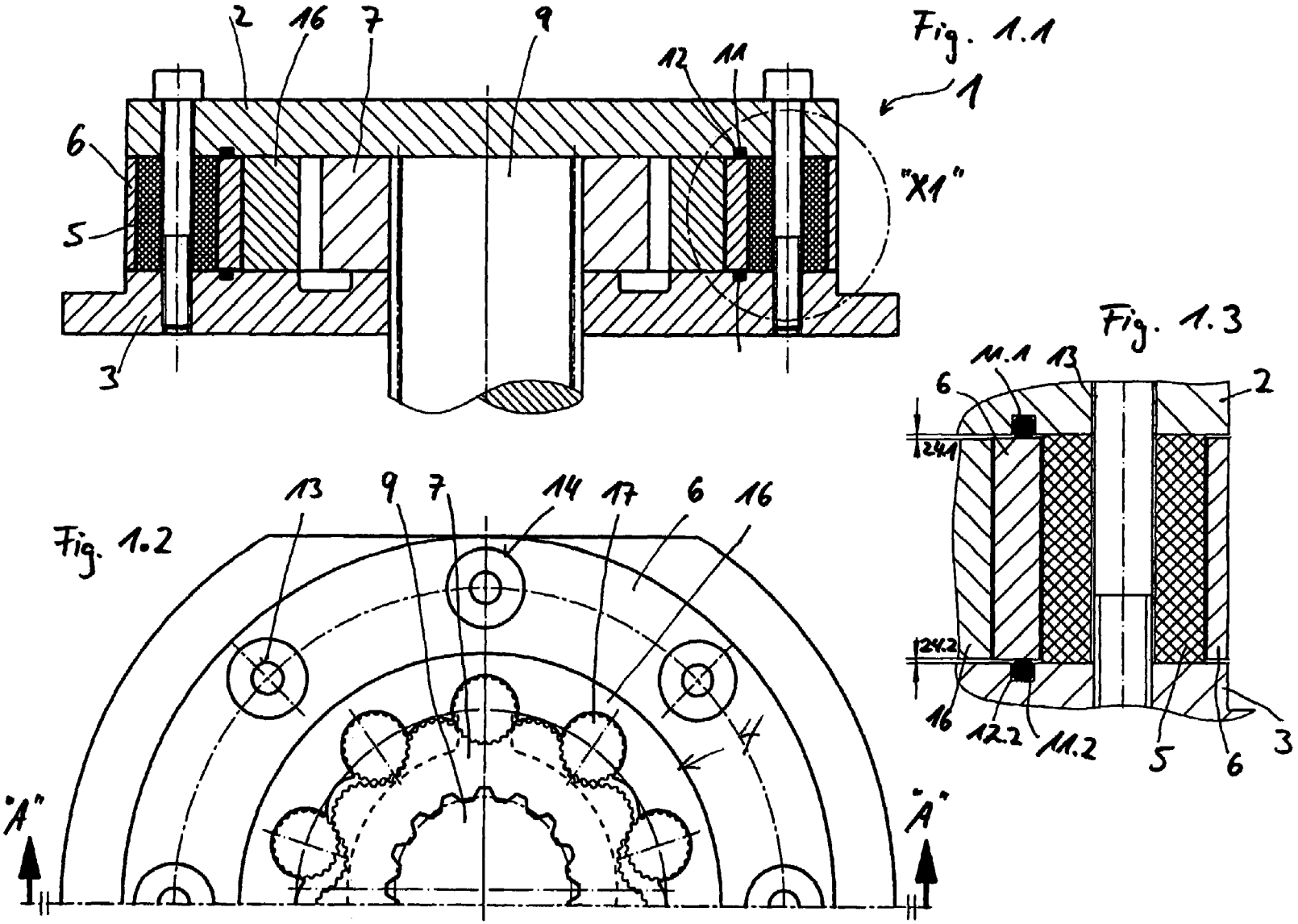
Fig. 1.1
1
"X1"
11
12
9
7
16
2
6
5
3
Fig. 1.3
2
3
6
5
13
11.1
11.2
12.1
12.2
6
16
24.1
24.2
Fig. 1.2
"A"
"A"
16
6
17
14
7
9
13

Fig. 2.1
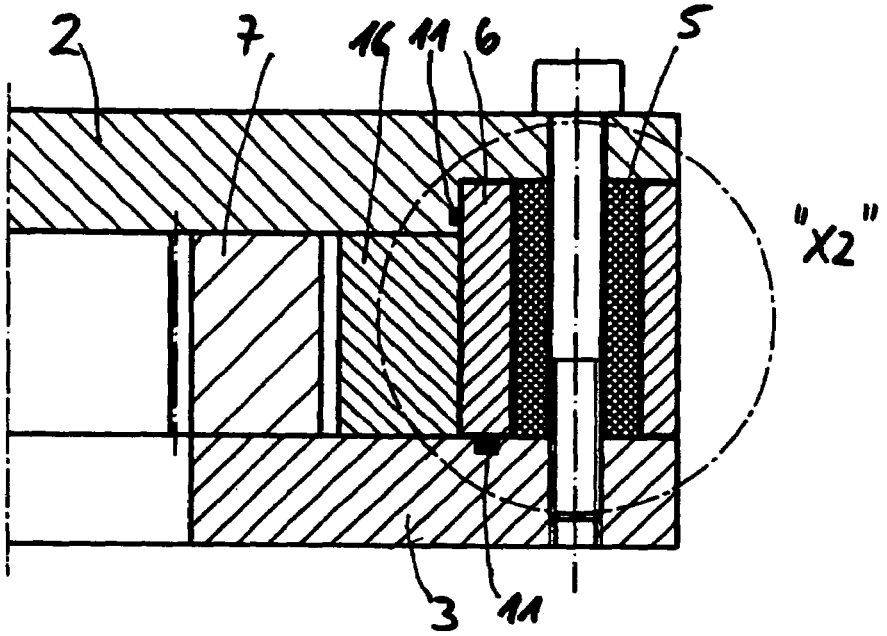
Fig. 2.2
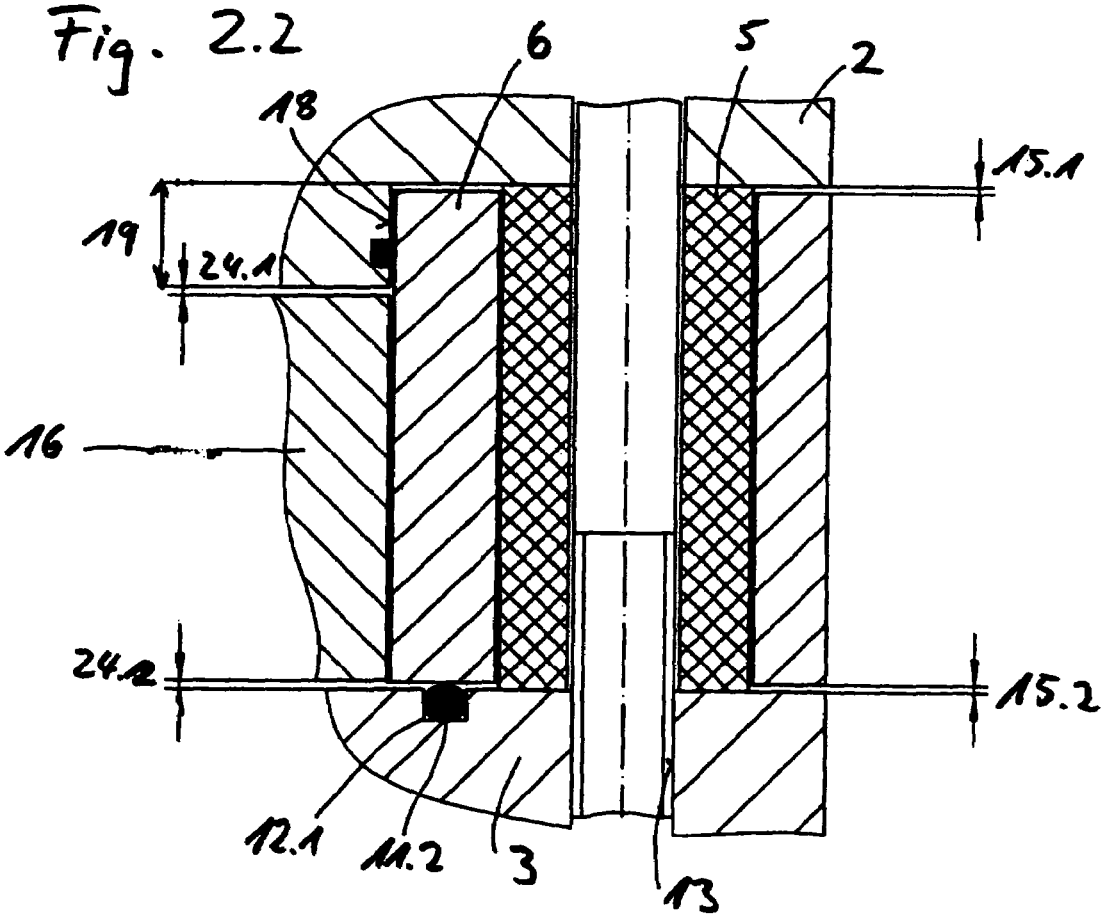

Fig. 3.1
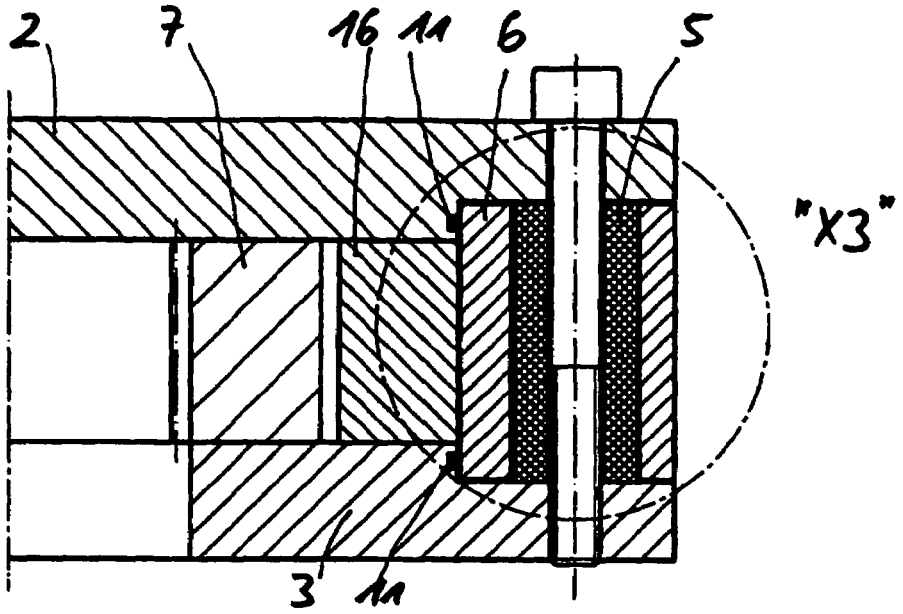
Fig. 3.2
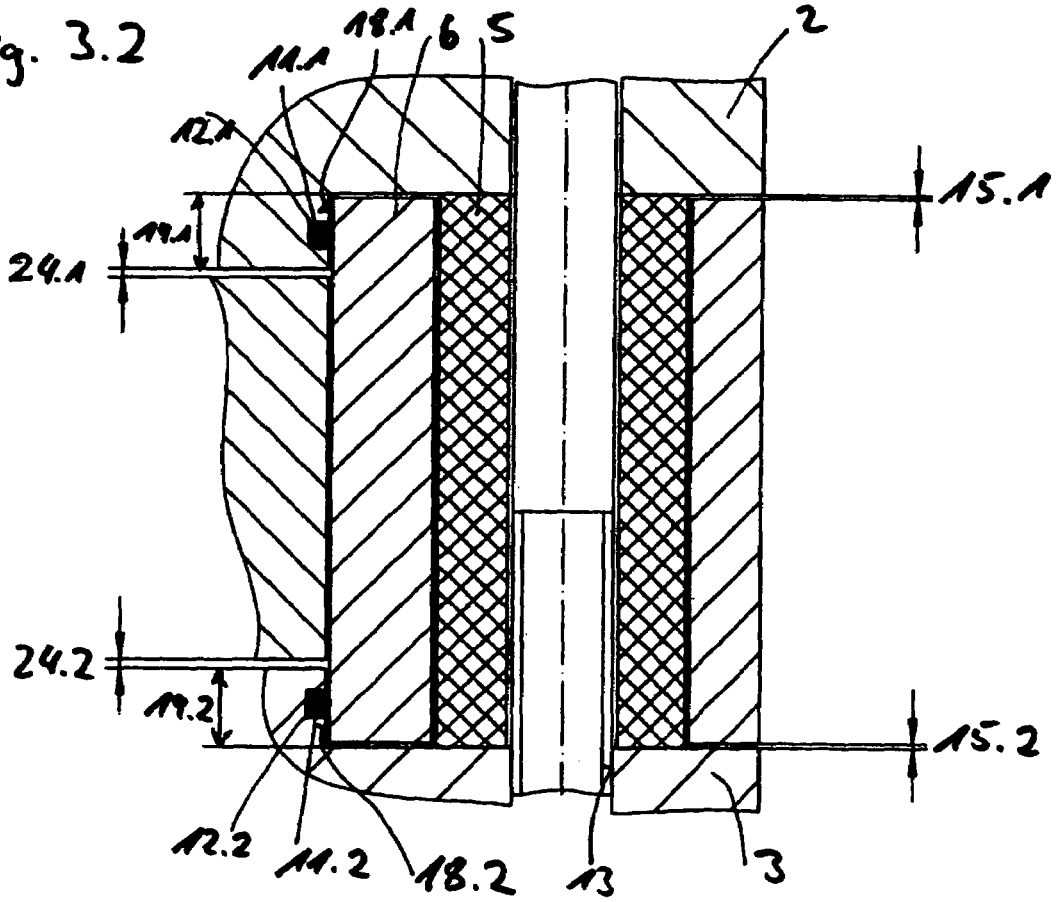

Fig. 4.1
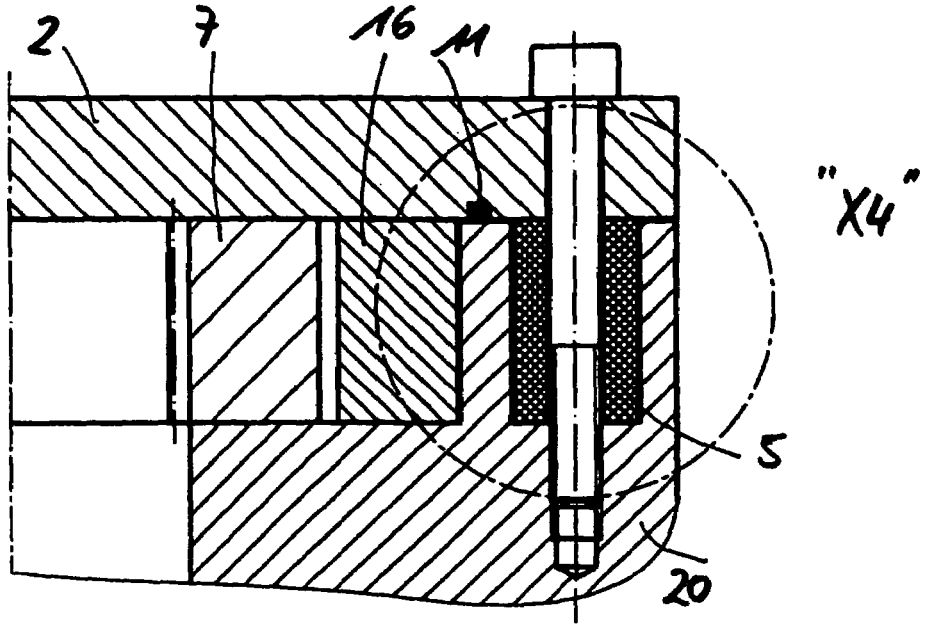
Fig. 4.2
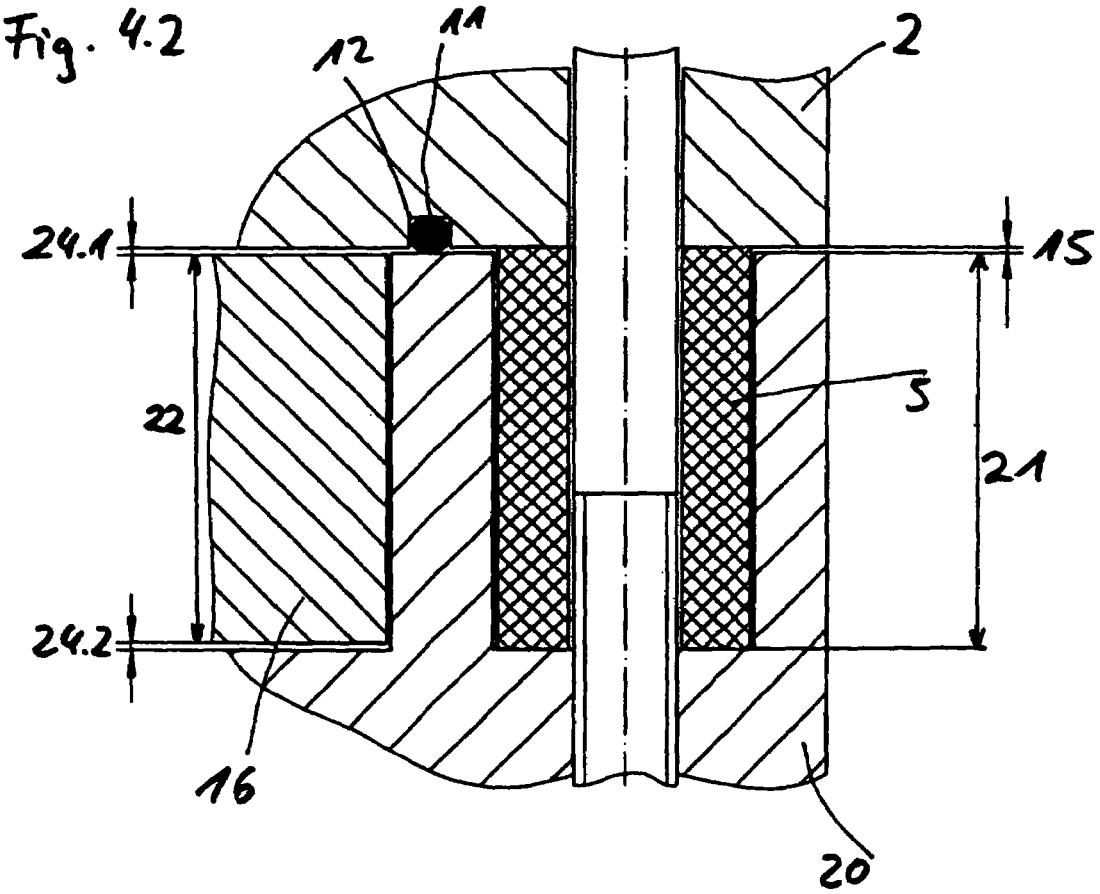

Fig. 5.1
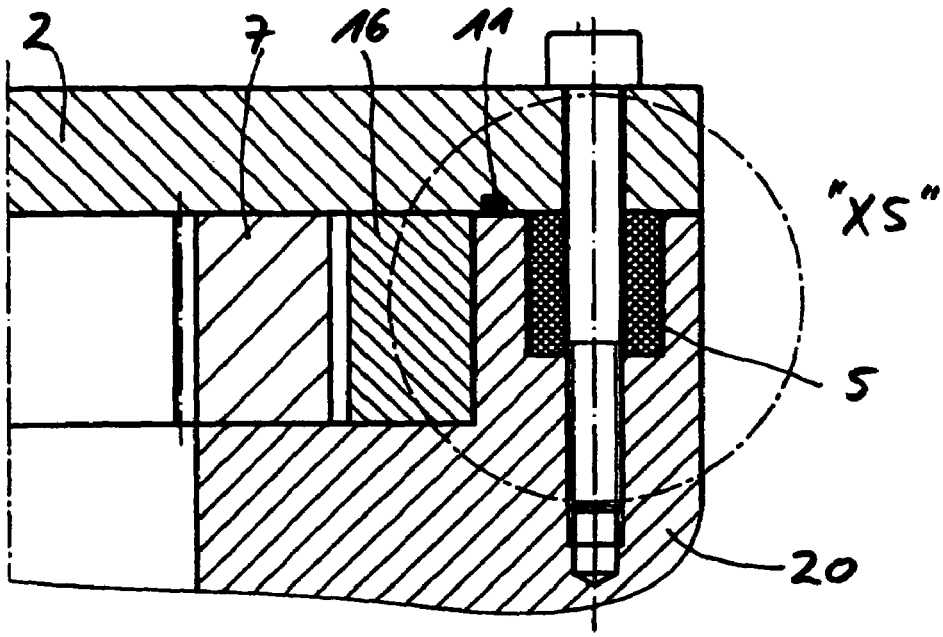
Fig. 5.2
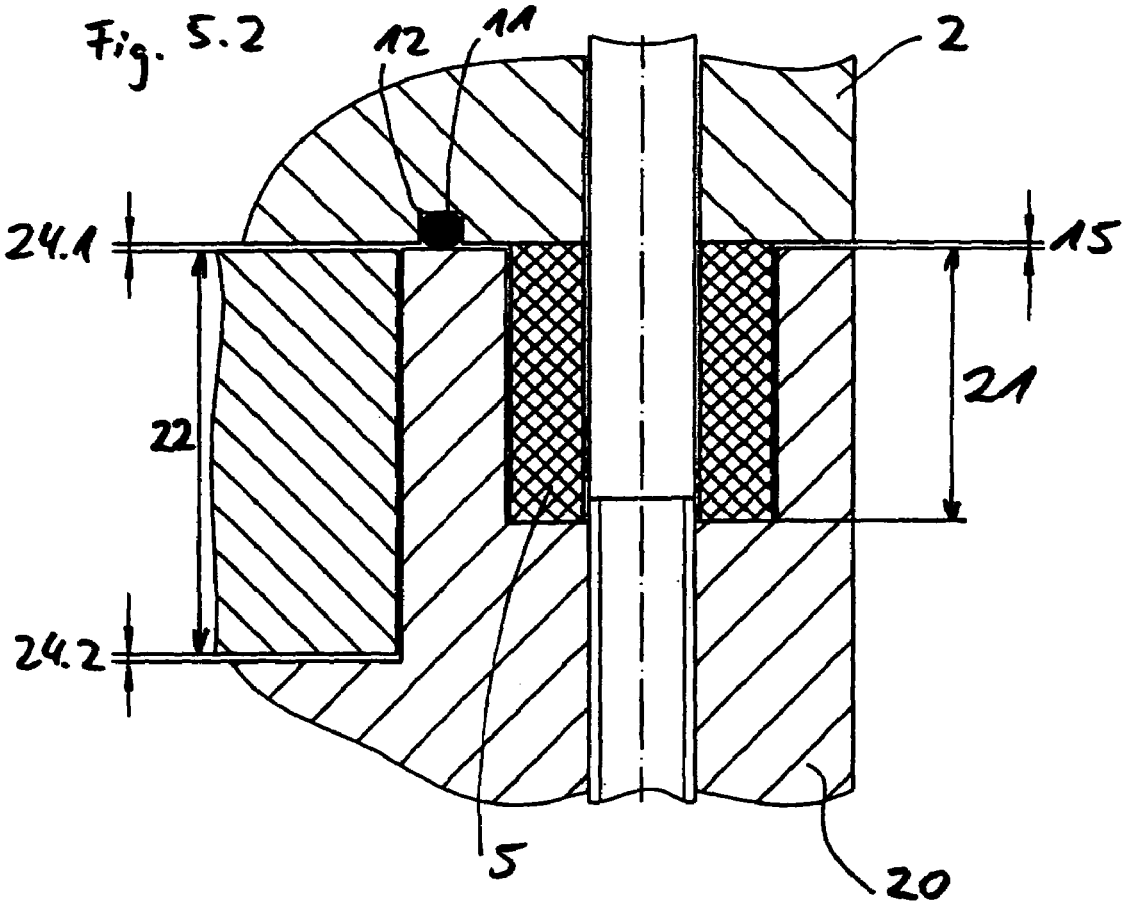

Pump Test without End Play – Optimization

Case: Steel; Wheelset: Sintered Steel

GEAR PUMP HAVING OPTIMAL AXIAL PLAY

This is a continuation of application no. PCT/EP2004/007729, filed Jul. 12, 2004, which claims priority to German application no. 103 31 979.4-15, filed Jul. 14, 2003, the entireties of each is incorporated herein by reference.

FIELD OF THE INVENTION

The invention relates to a pump, in particular an oil pump for internal combustion engines, comprising a pump case, with the pump case comprising a pump lid and a pump flange, with at least one toothed wheelset being arranged between the pump lid and the pump flange, and the pump lid and the pump flange are connected to one another via at least one distance element.

BACKGROUND OF THE INVENTION

The development of automobiles with low fuel consumption requires the optimization of vehicle and motor components. Here, for the energy consumption of the vehicle in the frequently occurring short-distance and city traffic the loss caused, among other things, by driving secondary power trains is particularly important. The drive performance of oil pumps, among other things, ensuring the lubrication of the motor can result in the reduction of the actual motor performance, which drastically increases the fuel consumption.

Up to 40° C. below zero, the function of the motor lubrication and a sufficiently fast motor lubrication must be ensured and during hot idling up to 160° C. the oil supply must not show any defects. The hot idling operation is characterized in a high internal leakage of the oil pump and a relatively high oil consumption of the motor. The hot idling operation is an essential operating point for sizing the oil pump.

In general, in the classical sizing of the pump the oil pump is designed for this operating point. In normal vehicle operation, this leads to an oversized oil pump, because the oil absorption line of the internal combustion engine progresses digressively over the rotation, with the characteristic pump line of the oil pump rising approximately linear in reference to the rotation. The excess supply of oil resulting therefrom is blown off via a pressure control valve in an energy consuming manner.

The above-described problem is enhanced in that the automotive industry, in particular, requests the use of oils with lower viscosity. Although this improves the function of pumps at temperatures below freezing, the volumetric effectiveness worsens at high temperatures.

Another problem is the fact that almost all pump cases are made from different materials in reference to the toothed wheelsets used. A multitude of pump cases are made from aluminum die casting, for example, for reasons of weight reduction, while the toothed wheelsets are produced from steel, in particular sintered steel. The different heat expansion coefficients of the pump case and the toothed wheelsets cause the necessarily designed end play between the toothed wheelset and the pump case to change during the increase and/or reduction of the temperature. At an increase of temperature, an approximately linear increase of the end play occurs, so that it results in an additional loss of volumetric effectiveness, which can amount to 50 to 60%. The volumetric effectiveness of a pump drops approximately linear at rising temperatures.

The above-described problem is shown in greater detail using an example of a vane cell pump with the following characteristics:

| | | |
|---|---|---|
| Case: | aluminum - die casting | |
| Wheel set: | sintered steel | |
| Height of wheel set: | 46 mm | |
| Temperature range: | −40° C. to 150° C. | |
| Heat expansion coefficient: | aluminum case: | 0.0000238° C.−1 |
| | Sintered steel wheelset: | 0.000012° C.−1 |

The end play of the pump is designed to 0.07 mm at 20° C.

Temperature difference 130° C. (20° C. to 150° C.)

Expansion of aluminum case:

46.07 mm+46.07 mm*0.0000238° C.−1*130° C.=46.213 mm expansion of sintered steel wheelset:

46.00 mm+46.00 mm*0.000012° C.−1*130° C.=46.07 mm

This results in an end play of 0.143 mm.

Temperature difference 60° C. (−40° C. to 20° C.):

Shrinkage of aluminum case:

46.07 mm−46.07 mm*0.0000238° C.−1*60° C.=46.004 mm shrinkage of sintered steel wheelset 46.00 mm−46.00 mm*0.000012° C.−1*60° C.=45.967 mm This results in an end play of 0.037 mm. p Due to the different heat expansion of the materials the end play increases at 150° C. to 0.143 mm and reduces to 0.037 mm at 40° C. Doubling the end play and reducing the viscosity of the medium leads to a loss of volumetric effectiveness by 50 to 60%. At low temperatures, due to the reduction of the end play, malfunctions can occur and result in considerable worsening of the mechanic effectiveness. An increase of end play by 0.01 mm results in approximately 1 liter/min reduction of flow at 100° C., 5.5 bar RPM (statement TV-H November 98). When designing an oil pump this volumetric loss has to be considered and the pump must be sized respectively bigger. Due to the bigger sized pump an excess supply of oil occurs at higher rotations, which has to be removed under power consumption.

SUMMARY OF THE INVENTION

The object of the invention is to design a pump, which is provided with an end play changing little at a temperature range from negative 40° C. to 160° C. and which has a volumetric effectiveness that drops only little over said temperature range.

The object is attained according to the invention in a pump, in particular an oil pump for internal combustion engines, comprising a pump case, with the pump case comprising a pump lid and a pump flange, with at least one toothed wheelset being arranged between the pump lid and the pump flange, and the pump lid and the pump flange being connected to one another via at least one distance element, with the distance element having a lower heat expansion coefficient than the pump lid, the pump flange, and/or the toothed wheelset.

The pump designed according to the invention allows an improvement of the volumetric effectiveness of a pump by 40 to 50% in reference to pumps having a pump case made from aluminum die casting and a toothed wheelset made from steel. The volumetric effectiveness of the pump according to the invention is higher by approx. 20 to 25% in reference to pumps having a pump case and a toothed wheelset made from steel. Furthermore, at low temperatures the mechanical effectiveness is improved. Another advantage relates to the effect on the pump design, because the size of the pump can be reduced. Further, a reduction of the power input and the weight of the pump is possible and, primarily, a reduction of the fuel consumption. By the design of the pump according to the invention the best possible end play can be calculated for almost all types of pumps with the best effectiveness possible. In many types of pumps this optimization can be retrofitted cost-effectively.

The advantages of the design of the pump according to the invention are shown using an example of a vane cell pump mentioned in prior art:

Optimized vane cell pump:

Heat expansion coefficient Invar=0.0000015° C.−1

Expansion of the distance element made from Invar (nickel steel):

46.09 mm+46.09 mm*0.0000015° C.−1*130° C.=46.098 mm

Expansion of the toothed wheelset made from sintered steel:

46.00 mm+46.00 mm*0.000012° C.−1*130° C.=46.072 mm

This results in an end play of 0.026 mm.

Shrinkage of the distance element made from Invar (nickel steel):

46.09 mm−46.09 mm*0.0000015° C.−1*60° C.=46.086 mm

Shrinkage of the toothed wheelset made from sintered steel:

46.00 mm−46.0 mm*0.000012° C.−1*60° C.=45.96 mm

This results in an end play of 0.119 mm.

By implementing a distance element with a heat expansion coefficient of 0.0000015° C.−1 the end play reduces to 0.026 mm at 150° C. and increases to 0.119 mm at −40 ° C. Therefore, it shows that the implementation of a distance element into the pump case, for example made from nickel steel (Invar) with 36% nickel content (heat expansion coefficient 0.0000015), converts the negative effect of the heat expansion into a positive one, i.e., at high temperatures the end play reduces and at low temperatures the end play increases.

The effect of the heat expansion with regard to the changes of the end play over the temperature is shown in the graph of FIG. 6.

The graph shows that in a combination of a pump case made from steel with a wheelset made from steel the intended end play remains constant over the temperature, because the pump case and the wheelset have an identical heat expansion coefficient. A pump case made from aluminum—die casting, optimized with regard to its weight, in combination with a wheelset made from sintered steel shows the increasing end play at higher temperatures and the leakages resulting therefrom, which are undesirable. The combination according to the invention of a light pump case made from aluminum die casting with a wheelset made from sintered steel and distance elements with a heat expansion coefficient smaller than the one of the wheelset and the pump case shows an end play reducing at rising temperatures.

Further, by the graph shown in FIG. 7, it is demonstrated how the volumetric effectiveness of a pump made according to prior art behaves at rising pressure and rising temperature, with the following test conditions being given:

| | |
|---|---|
| Pump case: | grey iron |
| Wheelset: | sintered steel |
| Type of wheelset: | planetary rotor set |
| Width of wheelset: | 18.00 mm |
| Displaced volume: | 5.40 cm3/R |
| Medium: | ATF transmission oil |
| Rotation: | 500 RPM |

It is clearly discernible that at 20° C. the volumetric effectiveness of a pump made according to prior art drops by approximately 7% at an increasing pressure. At a temperature increased to 80° C. the volumetric effectiveness drops by approximately 30%.

However, the graph of FIG. 8 shows how the volumetric effectiveness behaves under increasing pressure and increasing temperatures in a pump according to the invention, with the following test conditions being given:

Pump case: grey iron with integrated distance sockets made from Invar (nickel steel with 36% nickel content)

| | |
|---|---|
| Wheelset: | sintered steel |
| Type of wheelset: | planetary rotor set |
| Width of wheelset: | 18.00 mm |
| Displaced volume: | 5.40 cm3/R |
| Medium: | ATF transmission oil |
| Rotation: | 500 RPM |

It is discernible that the volumetric effectiveness of a pump according to the invention drops approximately 7% only under rising pressure and is almost independent from the temperature.

An advantageous embodiment of the invention provides that a circular pump disc is arranged between the pump lid and the pump flange, with at least one toothed wheelset being supported on it, with the circular pump disc having the same heat expansion coefficient as the distance element or a greater one.

Another advantageous embodiment of the invention is provided such that the heat expansion coefficient of the distance element is smaller than the respective heat expansion coefficient of the pump lid, the pump flange, the toothed wheelset, and/or the circular pump disc by at least the factor 10.

In a particularly advantageous embodiment of the invention it is provided that the heat expansion coefficient of the distance element is smaller than 0.00002° C.−1.

In a useful embodiment of the invention it is provided that the distance element is made from nickel steel, preferably with a nickel content of 36%.

In another useful embodiment of the invention it is provided that the distance element is a sintered piece. The sintered metal component can be provided with respective alloy elements in order to achieve a distance element with a heat expansion coefficient adjusted to the specific application.

In an advantageous embodiment of the invention it is provided that a planetary rotor set is supported concentrically in the circular pump disc, with the interior rotor being connected to a drive shaft and the pump lid, the circular pump disc, and the pump flange being separated from one another in a sealed manner, with distance elements being provided, whose height is greater than the height of the planetary rotor set by the amount of the intended end play and the height of the circular pump disc is smaller than the height of the distance element by the amount of the heat expansion coefficient, with the expansion gap located between the pump lid, the circular pump disc, and the pump flange being sealed by sealing elements.

In a particularly advantageous embodiment of the invention it is provided that the pump lid is connected to a collar, which extends into the circular pump disc and a planetary rotor set is supported in the circular pump disc, with the circular pump disc being penetrated by at least one distance elements, which contacts the pump lid and the pump flange.

In another advantageous embodiment of the invention it is provided that the pump lid and the pump flange are provided with a collar, which extends into the circular pump disc and a planetary rotor set is supported in the circular pump disc, with the circular pump disc, being penetrated by at least one distance element, which contacts the pump lid and the pump flange.

BRIEF DESCRIPTION OF THE DRAWINGS

The invention is shown in the following, using schematic drawings of exemplary embodiments. They show:

FIG. 1.1 a cross-section of a pump according to the invention along a line A-A in FIG. 1.2 in a modular board design;

FIG. 1.2 a top view of FIG. 1.1;

FIG. 1.3 a detail X1 according to FIG. 1.1;

FIG. 2.1 a cross-section of a first variant according to the invention;

FIG. 2.2 a detail X2 according to FIG. 2.1;

FIG. 3.1 a cross-section through a second variant according to the invention;

FIG. 3.2 a detail X3 according to FIG. 3.1;

FIG. 4.1 a cross-section through a third variant according to the invention;

FIG. 4.2 a detail X4 according to FIG. 4.1;

FIG. 5.1 a cross-section through a fourth variant according to the invention, FIG. 5.2 a detail X5 according to FIG. 5.1.

DETAILED DESCRIPTION OF ILLUSTRATIVE EMBODIMENTS

Figure 6:
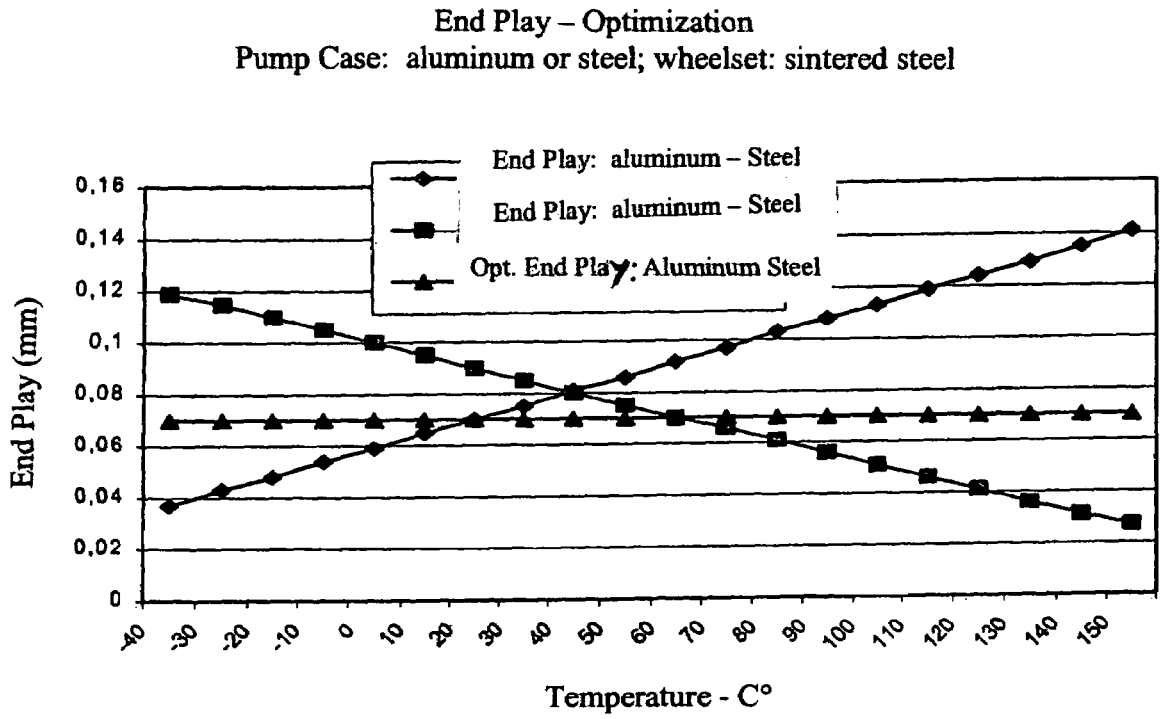
FIG. 6 a graph regarding the changes in the end play in reference to the temperature.
Figure 7:
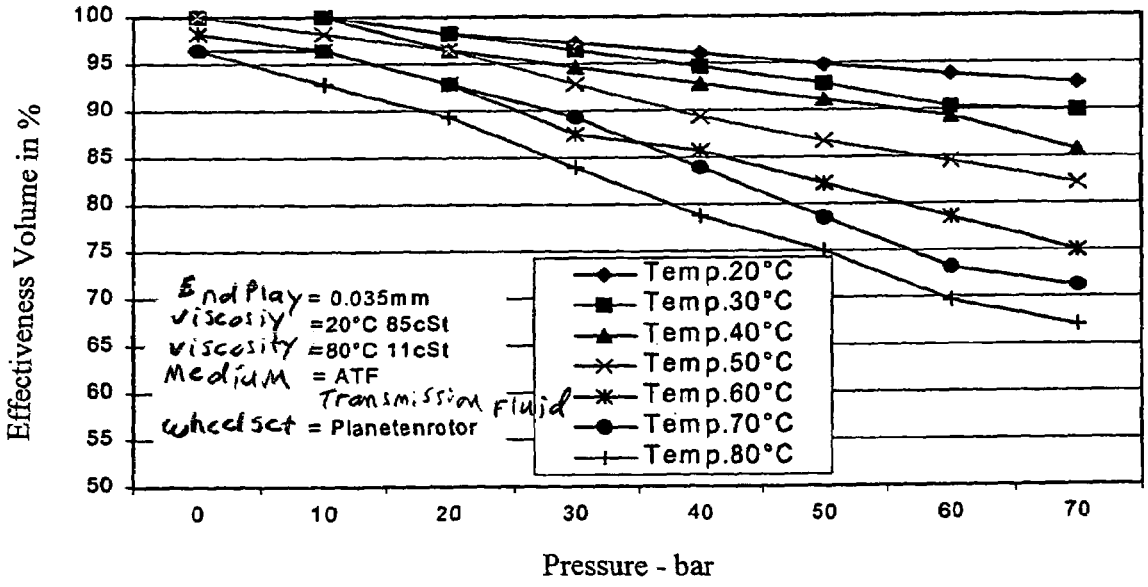
Fig 7 prior Art
FIG. 7 a graph regarding the changes of the volumetric effectiveness in reference to temperature and pressure in a pump according to the prior art.
Figure 8:
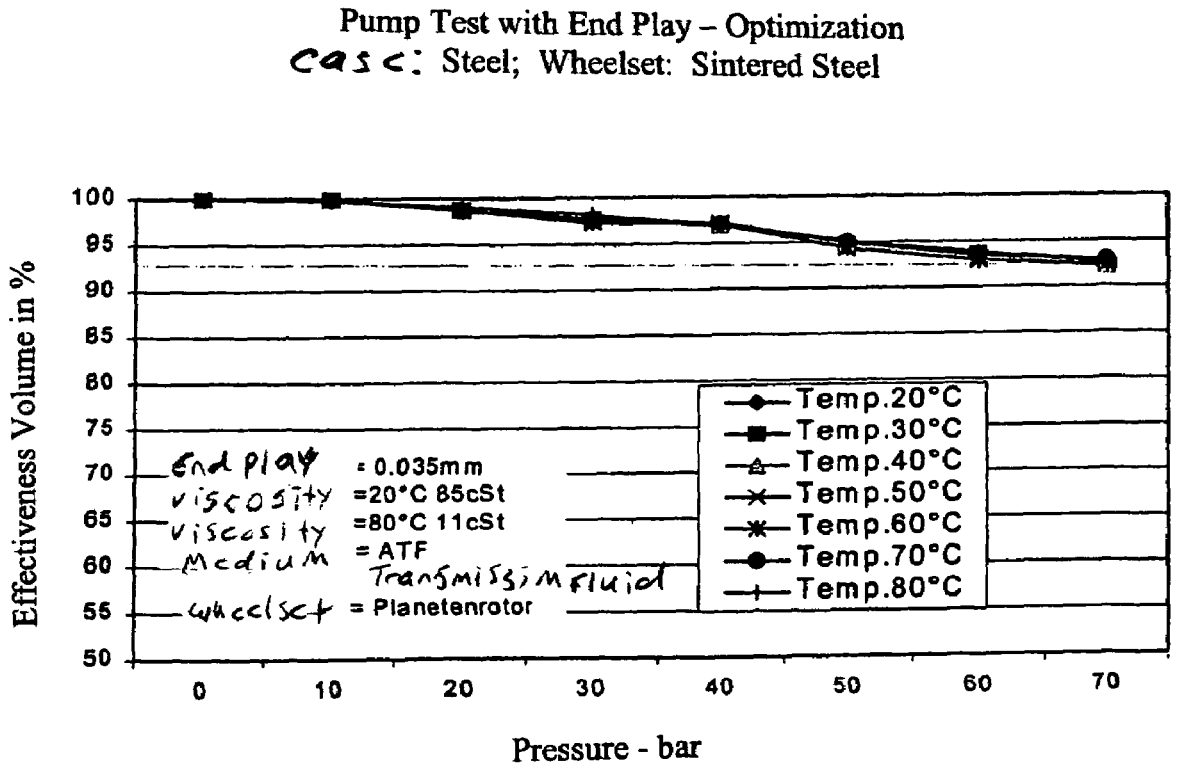
FIG. 8 a graph regarding the changes of the volumetric effectiveness in reference to temperature and pressure of a pump according to the invention.

FIG. 1.1 shows a cross-section through a pump case in a modular board design, which comprises a pump lid 2, a circular pump disc 6, and a pump flange 3. In the circular pump disc 6 a planetary rotor set 4 is supported concentrically, comprising an exterior rotor 16, planetary rotors 17, and an interior rotor 7. The interior rotor 7 is driven by the drive shaft 9. In the circular pump disc 6 support bores 14 are provided for the distance sockets 5. An O-ring groove 12 is implemented in the pump lid 2 and the pump flange 3, into which a sealing disc 11 (O-ring) is inserted, preventing leakage to the outside.

The distance sockets 5 are adjusted such to the height of the planetary rotor set that the distance sockets 5 are higher than the height of the planetary rotor set 4 by exactly the amount of the intended end play 24. The difference in the height between the distance sockets 5 and the planetary rotor set 4 is equivalent to the end play 24 at normal temperature.

The circular pump disc 6 is to be adjusted to the distance sockets 5 such that the circular pump disc 6 is smaller than the distance socket 5 by the amount of the heat expansion coefficient (heat expansion coefficient (circular pump disc) *height (circular pump disc)* temperature). This is equivalent to the expansion gap 15.

When screwing the pump 1 together, the pump lid 2 and the pump flange 3 are pressed onto the distance sockets 5. An expansion gap 15 forms between the pump lid 2, the circular pump disc 6, and the pump flange 3, which is sealed by the elastic O-rings 11.1 and 11.2.

The material of the distance sockets 5 is selected such that the heat expansion coefficient is always smaller than the one of the wheelset 4 and the circular pump disc 6. In the present case it is advantageous to use a nickel steel with 36% nickel content (Invar) as the material for the distance sockets 5. This material has a heat expansion coefficient of 0.0000015° C.−1, which is therefore smaller by the factor 10 than the heat expansion coefficient of sintered steel or steel. It is also advantageous for the wheel set 4 to be formed from sintered aluminum Si 14.

FIG. 1.2 shows that over a graduated circle eight penetrating holes 13 are bored into the pump lid 2 and eight threaded bores into the pump flange 3 for a screw connection using screws 14. Into the circular pump disc 6, at the same graduated circle of the pump lid 2 and at the same position as the penetrating bores 13, support bores 14 are provided for the distance elements, which are embodied as distance sockets 5.

FIG. 1.3 shows a detail according to FIG. 1.1, with a circular pump disc 6, a planetary rotor set 4, comprising an exterior rotor 16, planetary rotors 17, and an interior rotor 7, are supported concentrically between the pump lid 2 and the pump flange 3. In the pump lid 2 and the pump flange 3 an O-ring groove 12.1, 12.2 is implemented, into which a sealing ring 11.1, 11.2 (O-ring) is inserted, preventing leakage to the outside. The distance element 5 is provided with a greater height than the circular pump disc 6, so that an expansion gap 15.1, 15.2 forms.

In the pump according to the invention, as seen in FIG. 1.1, 1.2, and 1.3, the following values result from a pump test:

| | |
|---|---|
| End play at 20° C.: | 0.05 mm |
| Wheelset made from sintered steel: | 20.00 mm tall |
| Distance sockets made from nickel steel (36% Ni): | 20.05 mm tall |
| Temperature difference 130° C. | (20 to 150° C.) |
| Expansion of the wheelset to: | 20.0312 mm |
| Expansion of the distance sockets to: | 10.0539 mm |

Therefore, at 150° C. an end play of 0.0227 mm would develop.

| | |
|---|---|
| Temperature difference 60° C.: | (−40 to 20° C.) |
| Shrinkage of the wheelset to: | 19.9856 mm |
| Shrinkage of the distance sockets to: | 20.0482 mm |

Therefore, at negative 40° C. an end play of 0.0625 mm develops.

ATF—transmission oil at 150° C. approx. 3.4 mm2/s (cSt)

ATF—transmission oil at −40° C. approx. 100002/s (cSt)

FIG. 2.1 shows another embodiment according to the invention, which achieves the same behavior of the pump 1 according to FIG. 1. This construction is optimized for narrow wheelsets. The pump lid 2 is provided with a collar 18, which extends into the circular pump disc 6. The collar 18 is to be fitted into the circular pump disc 6. Due to the fact that the pump lid 2 is supported on the distance sockets 5, the collar length 19 increases at a rising temperature in the direction of the wheelset 4 and influences the end play 24. When designing the end play 24, the length of the collar 19 is to be sized such that the required end play 24 develops via the expansion of the collar length 19 of the pump lid 2. The pump lid 2 is made from die casting and the wheel set from steel or sintered steel. The circular pump disc 6 is made from aluminum die casting and the distance sockets 5 from nickel steel having 36% nickel content (Invar). In this construction the material of the pump flange 3 has no influence on the expansion. The heat expansion coefficient of the collar 18 should be as high as possible.

FIG. 2.2 shows a detail according to FIG. 2.1.

For the construction according to the invention the following values result:

| | |
|---|---|
| End play 20° C.: | = 0.04 mm |
| Width of wheelset: | = 5.0 mm |
| Collar length | = 7.0 mm |

Length of distance sockets: width of wheelset+collar length+end play=12.04 temperature difference:=130° C.

expansion distance sockets: (Invar)

12.04 mm+12.04 mm*0.0000015° C.−1*130° C.=12.0423 mm expansion wheelset (sintered steel)

5.0 mm+5.0 mm*0.000012° C.−1*130° C.=5.0078 mm expansion length of collar, aluminum 7.0 mm+7.0 mm*0.0000238° C.−1*130° C.=7.021 mm Therefore, at 150° C. an end play develops of:

12.0423 mm−5.0078 mm−7.021 mm=0.013 mm

Another constructive possibility is to make the circular pump disc from nickel steel with 36% nickel content (Invar). Alternatively, the circular pump disc can also be made from brass or red bronze with the heat expansion coefficient then being approximately 0.000018° C.−1.

FIG. 3.1 shows a cross-section through a similar construction as the one in FIG. 2.1, with in this construction both the pump lid 2 and the pump flange 3 are provided with a collar 18.1, 18.2. The pump lid 2 and the pump flange 3 should be made from aluminum, or a material with a similar heat expansion coefficient. The heat expansion coefficient of the collar 18 should be as high as possible.

FIG. 3.2 shows a detail according to FIG. 3.1.

FIG. 4.1 shows a cross-section through another construction, in which the circular pump disc 6 and the pump flange 3 are replaced by a compact pump case 20. The material of the pump case 20 can be grey cast or aluminum die casting, for example. The depth of the support bores 21 for the distance sockets 5 should be equivalent to the width of the wheelset 22. By a variation of the depth of the support bores 21 and the corresponding length of the distance sockets 5 the end play 24 can be influence additionally.

FIG. 4.2 shows a detail according to 4.1.

FIG. 5.1 shows an embodiment of the invention as seen in FIG. 4.1, with the depth of the support bore 21 and correspondingly the height of the distance element being smaller than the width of the wheelset 22. In particular, in wider wheelsets 4, for example >30 mm, the problem arises that the heat expansion coefficient between the material of the wheel set 4 and the distance element 5 is too great, causing the end play 24 to tend towards zero. This is solved in the distance element 5 having a smaller height than the width of the wheelset 22. The expansion of the distance element 5 can be calculated as follows:

L2*(heat expansion coefficient(case)*temperature+ L2*(heat expansion coefficient(distance element) *temperature FIG. 5.2 shows a detail according to FIG. 1.1

What is claimed:

1. An oil pump for internal combustion engines, the oil pump having a pump case including a pump lid, a pump flange, and a pump disc, the oil pump comprising:

at least one planetary rotor set having a height and arranged between said pump lid and said pump flange;

at least one distance element having a height and connected between said pump lid and said pump flange; and wherein said pump disc is secured between said pump lid and said pump flange by said distance element, and said pump disc has a different heat expansion coefficient than said planetary rotor set;

wherein the height of said distance element is greater than the height of said planetary rotor set by a desired amount of end play;

wherein said distance element has a lower heat expansion coefficient than said planetary rotor set; and wherein said distance element expands less than said planetary rotor set to reduce the end play when the temperature increases.

2. The pump of claim 1, wherein said pump disc defines a circular shape, and said distance element has a heat expansion coefficient lesser than or equal to the heat expansion coefficient of said pump disc.

3. The pump of claim 2, wherein said pump disc is separated from said pump lid and said pump flange by expansion gaps, wherein said expansion gaps are sealed by sealing elements.

4. The pump of claim 2, wherein a maximum heat expansion of said pump disc is equal or lesser than the difference in height between said distance element and said pump disc.

5. The pump of claim 2, wherein said pump disc has a height, and the height of said distance element is greater than the height of said pump disc so as to define a desired expansion gap disposed therebetween.

6. The pump of claim 1, wherein the heat expansion coefficient of said distance element (5) is less than the heat expansion coefficient of said planetary rotor set or said pump disc by at least a factor of 8.

7. The pump of claim 1, wherein the heat expansion coefficient of said distance element is smaller than 0.00002° $C.^{-1}$.

8. The pump of claim 1, wherein said distance element comprises nickel steel having about a 36% nickel content.

9. The pump of claim 1, wherein said distance element is a sintered part.

10. The pump of claim 1, wherein said planetary rotor set comprises:

an interior rotor; and a drive shaft; wherein said interior rotor is supported concentrically on said pump disc and said interior rotor is connected to said drive shaft and said pump lid.

11. The pump of claim 1, wherein said pump lid and said pump flange define a distance therebetween, and the height of said distance element is equal to the distance between said pump lid and said pump flange.

12. The pump of claim 1, wherein said distance element is disposed radially outward of said planetary rotor set.

13. The pump of claim 1, wherein said pump disc has a greater heat expansion coefficient than said planetary rotor set.

* * * * *